US005145073A

United States Patent [19]

Kitagawa et al.

[11] Patent Number: 5,145,073

[45] Date of Patent: Sep. 8, 1992

[54] PALLET FOR HOLDING GLASS PLATES IN STANDING POSTURE

[75] Inventors: Katsuhiko Kitagawa; Miki Yamada, both of Matsusaka, Japan

[73] Assignee: Central Glass Company, Limited, Ube, Japan

[21] Appl. No.: 734,283

[22] Filed: Jul. 9, 1991

[30] Foreign Application Priority Data

Jul. 9, 1990 [JP] Japan ..... 2-72851[U]

[51] Int. Cl.[5] ..... A47G 19/08

[52] U.S. Cl. ..... 211/41; 211/49.1; 211/175; 206/454; 206/449; 206/448

[58] Field of Search ..... 211/41, 49.1, 175; 206/454, 449, 448, 319

[56] References Cited

U.S. PATENT DOCUMENTS

| | | | |
|---|---|---|---|
| 3,147,860 | 9/1964 | Kean et al. | 206/448 |
| 3,809,234 | 5/1974 | Kurick | 206/448 |
| 3,938,660 | 2/1976 | Moehring | 206/448 X |
| 3,939,780 | 2/1976 | Bundy | 206/454 X |
| 3,961,709 | 6/1976 | Rowley | 206/448 |
| 3,995,738 | 12/1976 | Rowley et al. | 206/448 X |
| 4,010,849 | 3/1977 | Pater et al. | 206/454 X |
| 4,014,435 | 3/1977 | Rowley et al. | 206/454 X |
| 4,489,835 | 12/1984 | Tombal et al. | 211/41 |

*Primary Examiner*—David M. Purol

*Attorney, Agent, or Firm*—Fleit, Jacobson, Cohn, Price, Holman & Stern

[57] ABSTRACT

A pallet having a base frame and an upright rear frame to stand glass plates, which may include curved glass plates, on the base frame against the rear frame is disclosed. To keep the glass plate in the rearmost position apart from the rear frame the pallet has stoppers projecting from the rear frame. For each stopper, an upright support member defining therein a cross-sectionally rectangular channel is fixed to the rear frame, and a vertical slit is formed in the front wall of the support member. The stopper is attached to the support member by using a receptacle having an elongate main part and a perpendicularly projecting part both of which are cross-sectionally rectangular and either of which is fittable in the channel in the support member. The receptacle is formed with three receptive holes, which are of the same shape and size, at different locations. Each stopper has a holder to which a stopper head is attached, and the holder is fitted in one of the receptive holes of the receptacle. The distance of each stopper head from the rear frame is variable according to the curvature of the glass plates by selecting one from the three receptive holes of the receptacle and selectively inserting either the main part or the projecting part of the receptacle into the channel in the support member.

8 Claims, 3 Drawing Sheets

PALLET FOR HOLDING GLASS PLATES IN STANDING POSTURE

BACKGROUND OF THE INVENTION

This invention relates to a pallet for holding a plurality of glass plates, which may be either flat plates or curved plates, in a standing posture for storage and transfer purposes.

Usually a pallet for holding a plurality of glass plates in a standing posture and in a parallel arrangement has an upright rear frame, and a plurality of stoppers each of which has a cushioning head are attached to the rear frame so as to project toward the front side. When glass plates are stood against the rear frame the stopper heads support the rear face of the glass plate in the rearmost position. When curved glass plates are stood on the pallet such that the concave surface of each glass plate faces toward the rear frame it is necessary to suitably adjust the horizontal distance of each stopper head from the rear frame in order to keep the side edges of the glass plate in the rearmost position apart from the rear frame. If the side edges of the glass plate collide against the rear frame there is a possibility of breakage of the glass plate.

Concerning a pallet of the above described type, JP51-15714 (Utility Model) proposes to provide each of the stoppers attached to the rear frame with an auxiliary stopper which is a separate part and can be coaxially and detachably fitted on the primary stopper so as to enclose the primary stopper entirely. The auxiliary stopper is longer than the primary stopper and has a stopper head at its front end. Therefore, the auxiliary stoppers are used when it is desired to support the rear face of the glass plate in the rear-most position at a relatively long distance from the rear frame. When the relatively short length of the primary stoppers is sufficient the auxiliary stoppers are not used.

However, the auxiliary stoppers according to the above proposal are inconvenient for practical use of the pallet. When the auxiliary stoppers are not needed it is necessary to keep the auxiliary stoppers separate from the pallet. If the auxiliary stoppers are kept attached to the pallet by a provisional fastening means there is a possibility of losing the auxiliary stoppers while transferring the pallet. Furthermore, it will be necessary to prepare a plurality of auxiliary stoppers having different lengths for each of the primary stoppers.

SUMMARY OF THE INVENTION

It is an object of the present invention to provide a pallet on which a plurality of glass plates are to be stood against a rear frame, the pallet having a plurality of stoppers each of which has a stopper head and can be attached to the rear frame selectively in a plurality of different positions to change the horizontal distance of the stopper head from the rear frame and/or the height of the stopper head.

The present invention provides a pallet for holding a plurality of glass plates in a standing posture, the pallet comprising a base frame on which glass plates are to be stood, a rear frame which stands upright in a rear end region of the base frame and two uprightly elongate support members which are fixed to the front side of the rear frame and horizontally spaced from each other. Each of the two support members is a hollow and cross-sectionally rectangular member having a rear wall which is adjacent to the rear frame, two side walls and a front wall and defines therein a cross-sectionally rectangular and vertically elongate channel which opens at the top of the member. The front wall of this member is formed with a slit which extends from the top of the member vertically downward and provides access to the aforementioned channel, and each of the two side walls is formed with a plurality of through-holes at vertical intervals such that each of the through-holes is horizontally in alignment with one of the through-holes in the opposite side wall. For each of the two support members, the pallet further comprises a combination of a receptacle and a stopper. The receptacle has a main part, which is an elongate and cross-sectionally rectangular part fittable in the channel in the support member, and a projection part which is a cross-sectionally rectangular part extending perpendicularly from a front face of the main part and fittable in the aforementioned channel. The two opposite side faces of the projection part are grooved in a section adjacent to the front face of the main part such that when the main part is inserted in the channel in the support member the grooved section engages the slit in the front wall of the support member. The receptacle is formed with a first receptive hole in a top end face of the main part, a second receptive hole in a top end region of the front face of the main part and a third receptive hole in a front end face of the projection part, the first, second and third receptive holes being identical with each other in shape and size. The receptacle is further formed with a first through-hole which extends from a side face of the main part to the opposite side face through the first and second receptive holes, a second through-hole which extends from a side face of the projection part to the opposite side face through the third receptive hole and a third through-hole which extends from a side face of the main part to the opposite side face in a section adjacent to the projection part, each of the first, second and third through-holes conforming with the through-holes in the support member. The stopper comprises a holder and a stopper head attached to the holder. The holder is shaped so as to fit in any of the first, second and third receptive holes of the receptacle and formed with a through-hole which becomes in alignment with one of the first, second and third through-holes in the receptacle when the holder is inserted in one of the three receptive holes. For each stopper, the pallet includes at least one pin which can be inserted into any of the through-holes of the support member, the first, second and third through-holes of the receptacle and the through-hole of the stopper holder to fasten the holder to the receptacle and fasten the receptacle to the support member.

Preferably each stopper head is attached to the holder with a sort of universal joint to render the stopper head tiltable upward and downward and swivellable rightward and leftward, and the stopper head has a cushioning pad on the front surface. Besides the above stated essential elements, the pallet incorporates conventional front stoppers provided to the base frame and binding means to prevent the glass plates stood on the base frame from collapsing or falling down.

In the pallet according to the invention, the horizontal distance of each stopper head can be varied, for example, according to the curvature of the glass plates to be stood on the pallet, by selecting one from the three differently located receptive holes in the receptacle for attachment of the stopper holder to the receptacle and/or inserting either the main part or the projection part of the receptacle into the vertical channel in the support member. The height of the stopper head depends on the depth of insertion of the receptacle into the channel in the support member.

Therefore, a pallet according to the invention can be used for the storage or transfer of variously curved glass plates. In other words, the invention obviates the need for differently designed pallets for differently curved glass plates. In industrial practice, pallets according to the invention are convenient for keeping and can be circulated efficiently. Furthermore, no special or additional part is needed to change the distance of each stopper head from the rear frame of the pallet. While the pallet is on standby, each stopper and the receptacle for that stopper can be kept securely attached to the support member fixed to the rear frame.

DESCRIPTION OF THE PREFERRED EMBODIMENT

Figure 1:
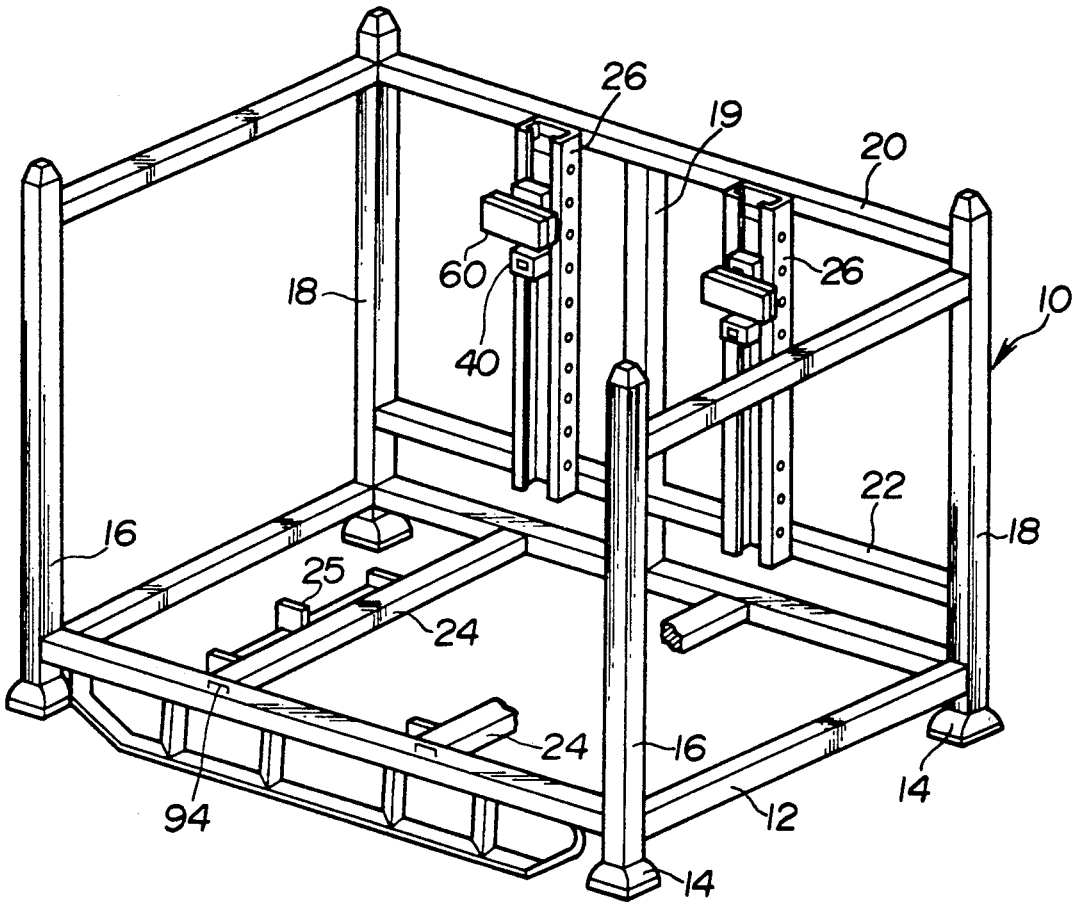
FIG. 1 is a perspective view of a pallet according to the invention.

FIG. 1 shows a pallet 10 which is an embodiment of the invention. The pallet 10 has a base frame 12 of a rectangular shape with a short leg 14 fixed at each corner. Two front pillars 16 and two rear pillars 18 stand at the four corners of the rectangular frame 12, respectively, and an upper beam 20 and a lower beam 22 are fixed to the rear pillars 18 so as to span the distance between the two pillars 18. The two rear pillars 18, and a supplementary pillar 19 if necessary, and the two beams 20, 22 constitute a rear frame of the pallet 10. A plurality of horizontal bars 24 are fixed to the base frame 12 at suitable intervals to stand glass plates on the pallet 10. The upper surface of each of these bars 24 is covered with a cushioning layer (not shown) such as a rubber sheet.

On the front side of the aforementioned rear frame a pair of upright support members 26 are fixed to the upper and lower beams 20 and 22. With respect to the lengthwise center of the beams 20, 22, one of the two support members 26 is located on the right-hand side and the other on the left-hand side. An assembly of a receptacle 40 and a stopper 60 is detachably attached to each of the two support members 26. As will be described hereinafter, when glass plates are stood on the bars 24 of the base frame 12 the front face of each stopper 60 makes contact with the rear surface of the glass plate placed nearest to the rear frame (20, 22) of the pallet 10.

Figure 2:
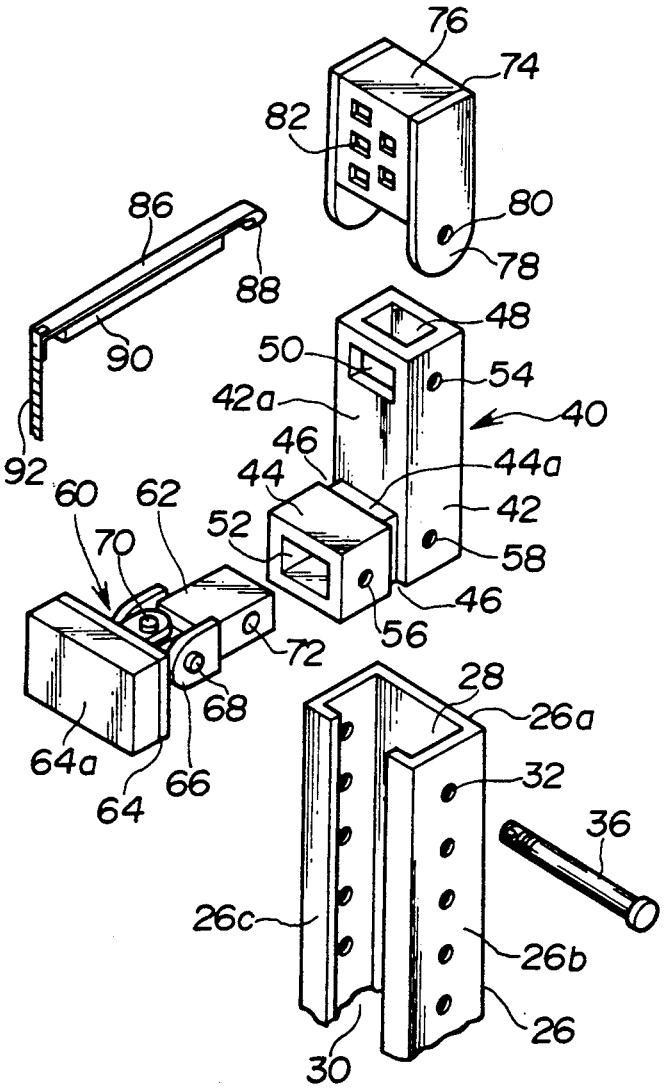
FIG. 2 is an exploded perspective view of a stopper unit to be attached to an upright support member of the pallet of FIG. 1.

Referring to FIG. 2, each of the upright support members 26 is a hollow, trough-like member having a nearly rectangular shape in horizontal cross sections. That is, the support member 26 has a rear wall **26*a*, two parallel side walls 26*b* and a front wall 26*c* so as to define a rectangular channel 28 which extends vertically through the whole length of the member 26, and a vertical slit 30 of a fairly large width is formed in the front wall 26*c* over the whole length of the member 26. The slit 30 provides access to the rectangular channel 28. Therefore, the support member 26 may be said to be C-shaped in cross sections. The two side walls 26*b* of the support member 26 are formed with a plurality of circular holes 32 of the same diameter at suitable vertical intervals. Each of the holes 32 in each side wall 26*b* is horizontally in alignment with one of the holes 32** in the opposite side wall.

The receptacle 40 is a generally L-shaped block having an elongate part 42, which is rectangular in cross sections, and a relatively short projection part 44 which is rectangular in vertical cross sections and extends perpendicularly from a bottom end region of the front face **42*a* of the elongate part 42. Except for the difference in length the two parts 42 and 44 are identical in cross-sectional shape and dimensions, and either of these two parts 42, 44 of the receptacle can be inserted into the channel 28 of each support member 26. At the root part of the projection part 44 adjacent to the front face 42*a* of the elongate part 42, vertical grooves 46 are formed in the two parallel side wall faces, respectively, such that the slitted front wall 26*c* of the support member 26 engages these grooves 46 when the elongate part 42 of the receptacle 40 is inserted in the support member 26. That is, the width of the grooved root part 44*a* of the projection part 44 is nearly equal to the width of the slit 30 of the support member 26. The receptacle 40 is formed with a rectangular hole 48 in the top face of the elongate part 42, a rectangular hole 50 in an upper region of the front face 42*a* of the elongate part 42 and a rectangular hole 52 in the front face of the projection part 44. The holes 48 and 50 intersect each other. These three holes 48, 50, 52 have the same shape and the same dimensions. A horizontal through-hole 54 extends through the junction of the rectangular holes 48 and 50 from a side face of the elongate part 42 to the opposite side wall of the same part 42, and a horizontal through-hole 56 extends through the rectangular hole 52 from a side face of the projection part 44 to the opposite side face of the same part 44. In a bottom section of the elongate part 42 there is a through-hole 58 which is parallel to the holes 54 and 56 and is positioned at the intersection of a vertical plane containing the axis of the hole 54 and a horizontal plane containing the axis of the hole 56. The holes 54, 56, 58 have the same diameter as the holes 32 in each support member 26**.

The stopper 60 has a holder 62 in the form of a rectangular block which fits in any of the three rectangular holes 48, 50, 52 of the receptacle 40. A stopper head 64 having a cushioning pad **64*a* on the front face is attached to the holder 62 by a joint 66, which is a sort of universal joint having a horizontal axle 68 and a vertical axle 70. The stopper head 64 is tiltable upward and downward about the axle 68 and swivellable rightward and leftward about the axle 70. The holder 62 is formed with a horizontal through-hole 72 which becomes in alignment with one of the holes 54 and 56 of the receptacle 40 when the holder 62 is inserted into one of the three rectangular holes 48, 50, 52 of the receptacle 40**.

A retainer 74 is used to fix the receptacle 40 to each support member 26. The retainer 74 has a body part 76 in the form of a rectangular block and two downwardly protruding leg plates 78 attached to the two parallel side faces of the body part 76, respectively. Including the leg plates 78, the retainer 74 is slidably fittable in the rectangular channel 28 of each support member 26, and the width of the body part 76 itself is equal to the width of the receptacle 40. In the downwardly protruding region of each leg plate 78 there is a hole 80 which becomes in alignment with either of the holes 54 and 58 in the elongate part 42 of the receptacle 40. In the front face of the body part 76 there are a plurality of relatively small, rectangular holes 82 at vertical intervals. When the retainer 74 is inserted in the support member 26 the holes 82 are accessible through the slit 30 of the support member 26.

Figure 3:
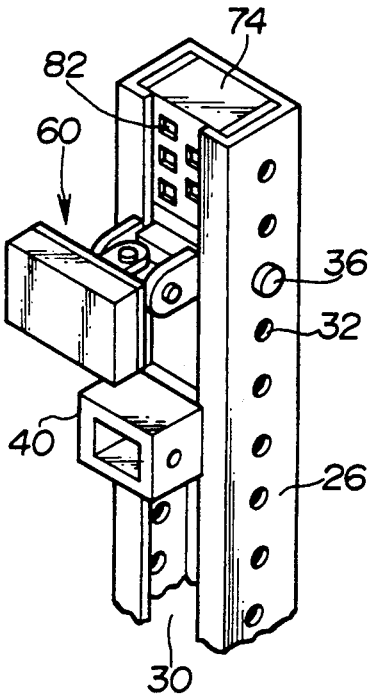
FIG. 3 is a perspective view of the support member to which the stopper unit of FIG. 2 is attached.

FIG. 3 shows a case where the elongate part 42 of the receptacle 40 is inserted in the channel 28 of each support member 26 such that the projection part 44 is at the bottom of the inserted receptacle 40. In this case the holder 62 of the stopper 60 is inserted into the rectangular hole 50 in the front face 42*a* of the elongate part 42 of the receptacle 40. Then the retainer 74 is inserted into the channel 28 of the support member 26 so as to align the holes 80 of the retainer, the hole 54 of the receptacle 40, the hole 72 of the stopper 60 and the holes 32 at a desired level of the support member 26, and a pin 36 is inserted in the aligned holes. The inserted pin 36 is locked by using a nut or a cotter pin (not shown).

Figure 6:
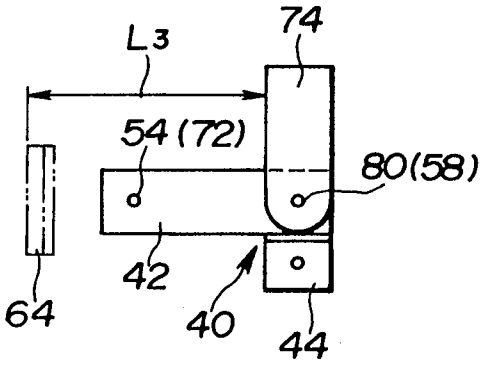
FIGS. 4 to 6 are respectively diagrammatic illustrations of three different positions of the front face of the stopper unit according to three different manners of attaching the stopper unit to the support member.
Figure 5:
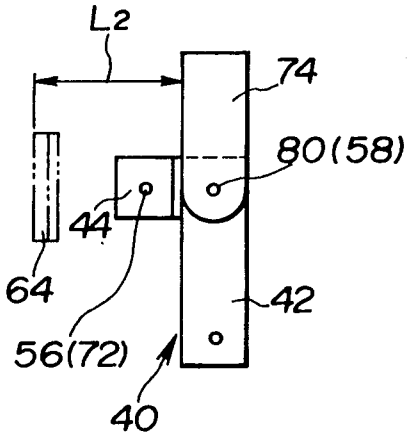
Figure 4:
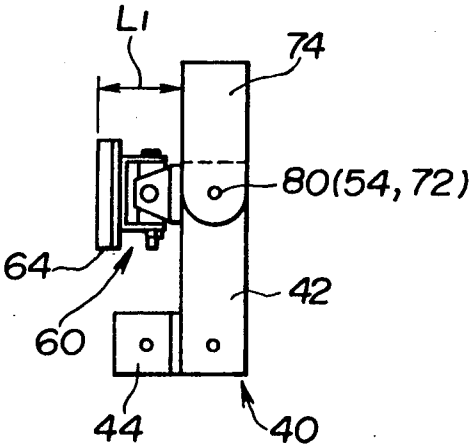

In the above described case, the horizontal distance of the front face of the stopper head 64 from the support member 26 is relatively short and corresponds to the distance $L_1$ indicated in FIG. 4. In this case the vertical position of the stopper 60 is widely variable by selectively using the vertically intervalled holes 32 of the support member 26. When the receptacle 40 is inversely inserted in the support member 26 the holder 62 of the stopper 60 can be inserted into the rectangular hole 52 in the projection part 44 of the retainer 40 and fixed to the retainer 40 by inserting another pin (not shown) through the hole 56 of the receptacle 40 and the hole 72 of the stopper 60. In this case the horizontal distance of the front face of the stopper head 64 from the support member 26 becomes longer than in the preceding case and corresponds to the distance $L_2$ indicated in FIG. 5. Also in this case the vertical position of the stopper 60 is widely variable by selectively using the holes 32 in the support member 26. When the projection part 44 of the receptacle 40 is inserted in the channel 28 of the support member 26 the elongate part 42 of the retainer 40 lies horizontally, and the holder 62 of the stopper 60 is inserted into the rectangular hole 48 of the receptacle 40 and fixed to the receptacle by inserting another pin (not shown) through the hole 54 of the receptacle and the hole 72 of the stopper 60. In this case the horizontal distance of the front face of the stopper head 64 from the support member 26 becomes maximum and corresponds to the distance $L_3$ indicated in FIG. 6, but in this case the vertical position of the stopper 60 is limited to the level of the top of the support member 26.

Figure 7:
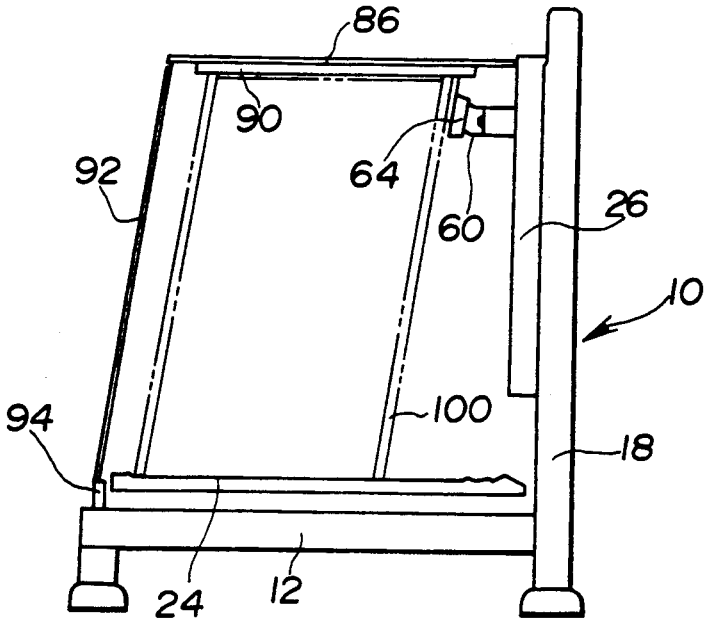
FIG. 7 is a side elevational view of the pallet of FIG. 1 and illustrates the manner of holding glass plates stood on the pallet.

Referring to FIGS. 1 and 7, in using the above described pallet 10, a plurality of glass plates 100 are stood on the horizontal bars 24 of the base frame 12 in a parallel arrangement such that the rear side of each glass plate faces toward the rear frame (20, 22) to which the support members 26 are fixed. The glass plates 100 are stood so as to slightly incline toward the rear frame (20, 22). The stopper head 64 (having a cushioning pad 64*a* on the front face) of the stopper 60 attached to each support member 26 makes contact with the rear surface of the glass plate 100 in the rearmost position. The height of the stoppers 60 and the horizontal distance of each stopper head 64 from the support member 26 are variable as explained above and chosen according to the height and/or curvature of the glass plates. As shown in FIG. 1, on one side of each of the horizontal bars 24 there is a front stopper 25 to prevent the lower edge of the glass plate at the forefront from sliding forward. The horizontal position of each front stopper 25 is adjustable.

To bind the standing glass plates 100 to the pallet 10, a clamper 86 extends horizontally from each of the support members 26 so as to make contact with the top edge of each glass plate, and a band 92 is stretched from the front end of the clamper 86 to a hook 94 attached to a front member of the base frame 12. As shown in FIG. 2, the clamper 86 is a thin bar-like member having a U-shaped hook 88 at the rear end. The rear end section of the top clamper 86 is inserted into one of the holes 82 in the front face of the retainer 74 fitted in the support member 26 to allow the hook 88 to engage that hole 82. The selection of one out of the plurality of holes 82 is made according to the height of the glass plates 100 stood on the pallet 10. A cushioning layer 90 is attached to the lower surface of each clamper 86. Thus, the clampers 86, bands 92, front stoppers 25 and the rear stoppers 60 cooperatively serve the purpose of preventing the standing glass plates 100 from staggering or collapsing down.

When the pallet 10 is not in use, the receptacle 40, stopper 60 and retainer 74 for each support member 26 are kept attached to the support member 26.

What is claimed is:

1. A pallet for holding a plurality of glass plates in a standing posture, comprising:

a base frame on which glass plates are to be stood;

a rear frame which stands upright in a rear end region of said base frame;

two uprightly elongate support members which are fixed to the front side of said rear frame and horizontally spaced from each other, each of the support members being a hollow and cross-sectionally rectangular member having a rear wall which is adjacent to said rear frame, two side walls and a front wall and defining therein a cross-sectionally rectangular and vertically elongate channel which opens at the top of the member, said front wall being formed with a slit which extends from the top of the member vertically downward and provides access to said channel, each of said two side walls being formed with a plurality of through-holes at vertical intervals such that each of said through-holes is horizontally in alignment with one of the through-holes in the opposite side wall;

for each of said two support members, a receptacle having a main part which is an elongate and cross-sectionally rectangular part fittable in said channel of the support member and a projection part which is a cross-sectionally rectangular part extending perpendicularly from a front face of said main part and fittable in said channel of the support member, two opposite side faces of said projection part being grooved in a section adjacent to said front face of said main part such that when said main part is inserted in said channel of the support member the grooved section fits in said slit in the front wall of the support member, the receptacle being formed with a first receptive hole in a top end face of said main part, a second receptive hole in a top end region of the front face of said main part and a third receptive hole in a front end face of said projection part, said first, second and third receptive holes being identical with each other in shape and size, the receptacle being further formed with a first through-hole which extends from a side face of said main part to the opposite side face through said first and second receptive holes, a second through-hole which extends from a side face of said projection part to the opposite side face through said third receptive hole and a third through-hole which extends from a side face of said main part to the opposite side face in a section adjacent to said projection part, each of said first, second and third through-holes conforming with said through-holes in the support member;

for each of said two support members, a stopper comprising a holder and a stopper head which is attached to said holder, said holder being shaped so as to fit in any of said first, second and third receptive holes of said receptacle and formed with a through-hole which becomes in alignment with one of said first, second and third through-holes of said receptacle when the holder is inserted in one of said first, second and third receptive holes; and for each of said two support members, at least one pin which can be inserted into any of said through-holes of the support member, said first, second and third through-holes of said receptacle and said through-hole of said holder of said stopper to fasten said holder to said receptacle and fasten said receptacle to the support member.

2. A pallet according to claim 1, wherein said stopper head is attached to said holder so as to be tiltable upward and downward and swivellable rightward and leftward.

3. A pallet according to claim 1, wherein said holder is a cross-sectionally rectangular member, said first, second and third receptive holes of said receptacle being cross-sectionally rectangular.

4. A pallet according to claim 1, wherein said projection part of said receptacle extends from a bottom section of said main part.

5. A pallet according to claim 4, wherein said projection part is shorter than said main part.

6. A pallet according to claim 4, wherein said third through-hole of said receptacle is located such that a plane containing the axis of said first through-hole and the axis of said third through-hole is perpendicular to a plane containing the axis of said second through-hole and the axis of said third through-hole.

7. A pallet according to claim 1, further comprising, for each of said two support members:

a retainer which has a cross-sectionally rectangular body and is fittable in said channel of the support member so as to rest on said receptacle fitted in said channel, a front face of said body being formed with a plurality of holes at vertical intervals;

a clamping strip which is hooked at one end so as to engage any of said plurality of holes in said retainer;

a band which extends from the opposite end of said clamping strip; and a hook fixed to a front end part of said base frame to hold said band in a stretched state when said clamping strip is attached to said retainer by using one of said holes of the retainer and lies on the top edges of glass plates stood on the pallet.

8. A pallet according to claim 7, further comprising a plurality of front stoppers each of which is attached to said base frame so as to support a lower end region of the forefront of glass plates stood on the pallet, the horizontal distance of each of the front stoppers from said rear frame being adjustable.

* * * * *